US009340981B1

(12) United States Patent
Gardner

(10) Patent No.: US 9,340,981 B1
(45) Date of Patent: May 17, 2016

(54) SNOW REMOVAL ASSEMBLY

(71) Applicant: James Cyrus Gardner, Quesnel (CA)

(72) Inventor: James Cyrus Gardner, Quesnel (CA)

( * ) Notice: Subject to any disclaimer, the term of this patent is extended or adjusted under 35 U.S.C. 154(b) by 0 days.

(21) Appl. No.: 14/575,195

(22) Filed: Dec. 18, 2014

(51) Int. Cl.
*E04D 13/10* (2006.01)

(52) U.S. Cl.
CPC ..... *E04D 13/106* (2013.01)

(58) Field of Classification Search
CPC ..... E01H 5/02; E04D 13/106
USPC ..... 37/273
See application file for complete search history.

(56) References Cited

U.S. PATENT DOCUMENTS 1,309,340 A * 7/1919 Rhines ..... A01D 7/10 56/400.11
1,572,824 A * 2/1926 Tatge ..... E02F 3/02 294/53.5
2,432,780 A * 12/1947 Mader ..... E01H 5/02 16/235
2,552,016 A * 5/1951 Mann ..... A01D 7/04 37/241
2,958,143 A * 11/1960 Bonic ..... E01H 5/02 15/236.01
3,218,738 A * 11/1965 Bowerman ..... E04D 13/106 294/54.5
3,483,643 A * 12/1969 Wenzel ..... E01H 5/02 152/236.01
3,526,979 A * 9/1970 Ladewski ..... E01H 5/02 37/273
3,727,964 A * 4/1973 Nordvik ..... E01H 5/02 294/54.5
4,094,543 A * 6/1978 Fratini ..... E01H 5/02 294/54.5
4,249,767 A * 2/1981 Andreasen ..... E04D 13/106 294/54.5
D265,007 S 6/1982 Cuta
5,083,388 A 1/1992 Cooley
5,511,328 A * 4/1996 Fingerer ..... E01H 5/02 294/54.5
5,749,613 A * 5/1998 Rapp ..... A01B 1/00 15/145
5,791,072 A * 8/1998 Schbot ..... E01H 5/02 294/57
5,791,707 A 8/1998 Szakurski
6,092,315 A 7/2000 Katauskas
6,158,791 A 12/2000 Drew
6,189,942 B1 * 2/2001 Peterson ..... E04D 13/106 294/54.5
6,338,210 B1 * 1/2002 Mele ..... E04D 13/106 294/54.5
6,578,890 B1 * 6/2003 Ross ..... E04D 13/106 294/53.5
D533,755 S 12/2006 Yates, III
7,296,368 B1 * 11/2007 Rigo ..... E04D 13/106 294/54.5
8,347,528 B1 1/2013 Seltzer
2007/0028487 A1 * 2/2007 Larson ..... E01H 5/02 37/278
2011/0099858 A1 5/2011 Jakus et al.

* cited by examiner

*Primary Examiner* — Jamie L Mcgowan

(57) ABSTRACT

A snow removal assembly for removing snow from a roof includes a building structured to have a roof. A rod is provided. The rod may be gripped by a user when the user is standing on the roof of the building. A block is coupled to the rod. The block may be urged through snow on the roof of the building. A pair of wings is movably coupled to the block. The wings are retained in a stored position when the block is urged through the snow in a first direction. The wings do not disturb the snow. The wings are retained in a deployed position when the block is urged through the snow in a second direction. The wings urge the snow off of the roof.

11 Claims, 5 Drawing Sheets

SNOW REMOVAL ASSEMBLY

BACKGROUND OF THE DISCLOSURE

Field of the Disclosure

The disclosure relates to removal devices and more particularly pertains to a new removal device for removing snow from a roof.

SUMMARY OF THE DISCLOSURE

An embodiment of the disclosure meets the needs presented above by generally comprising a building structured to have a roof. A rod is provided. The rod may be gripped by a user when the user is standing on the roof of the building. A block is coupled to the rod. The block may be urged through snow on the roof of the building. A pair of wings is movably coupled to the block. The wings are retained in a stored position when the block is urged through the snow in a first direction. The wings do not disturb the snow. The wings are retained in a deployed position when the block is urged through the snow in a second direction. The wings urge the snow off of the roof.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
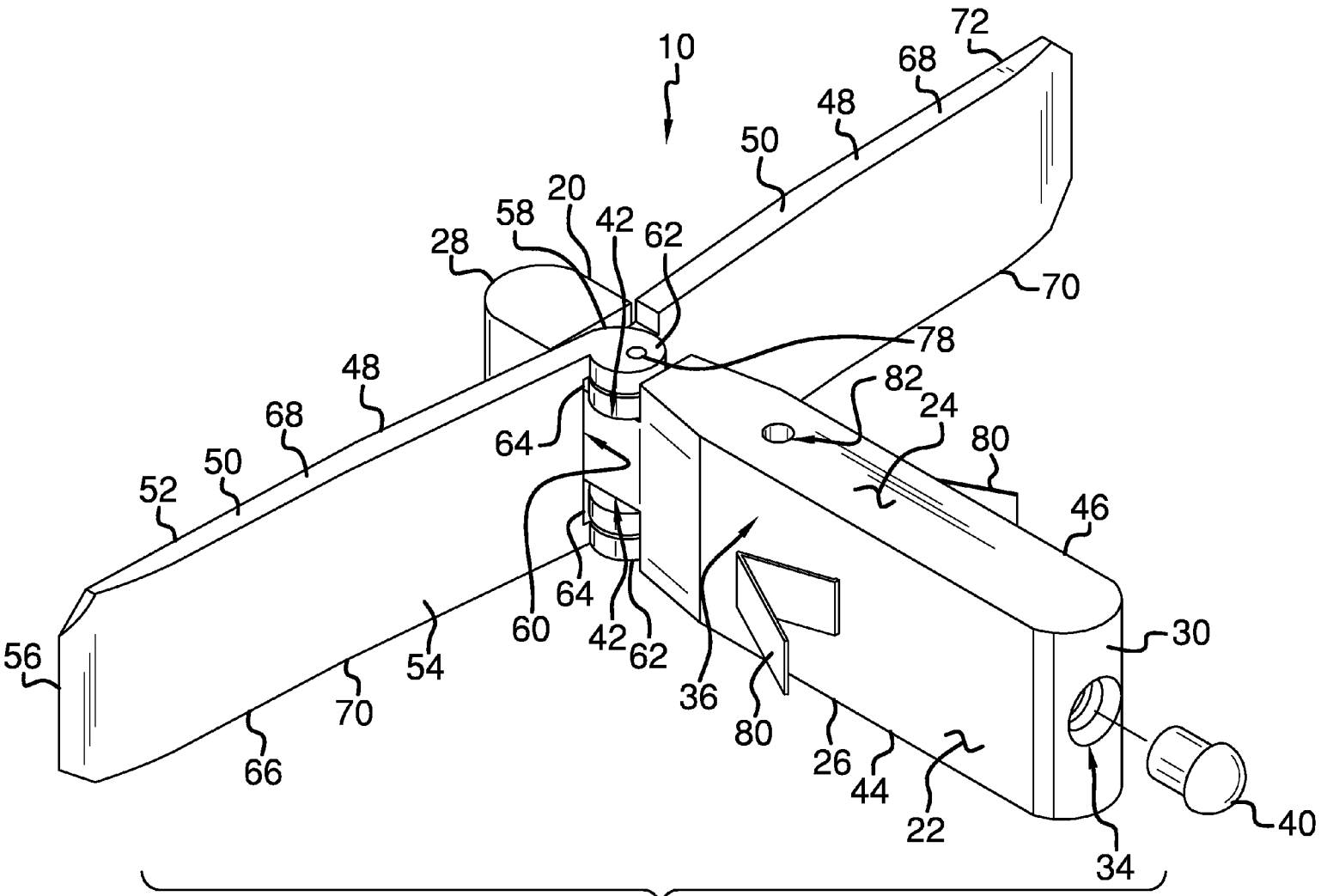
FIG. 1 is a perspective view of a snow removal assembly according to an embodiment of the disclosure.
Figure 2:
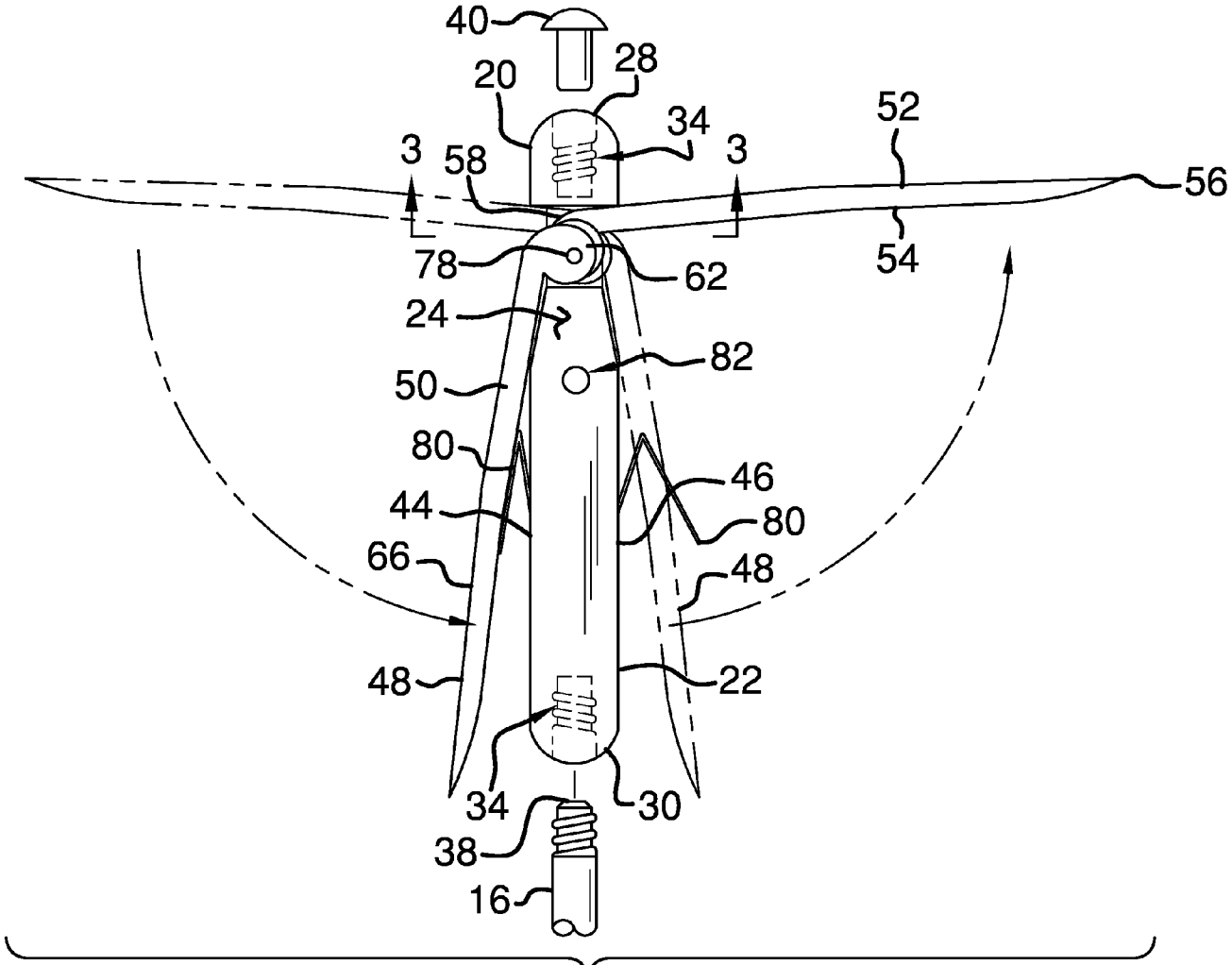
FIG. 2 is a bottom side view of an embodiment of the disclosure.
Figure 3:
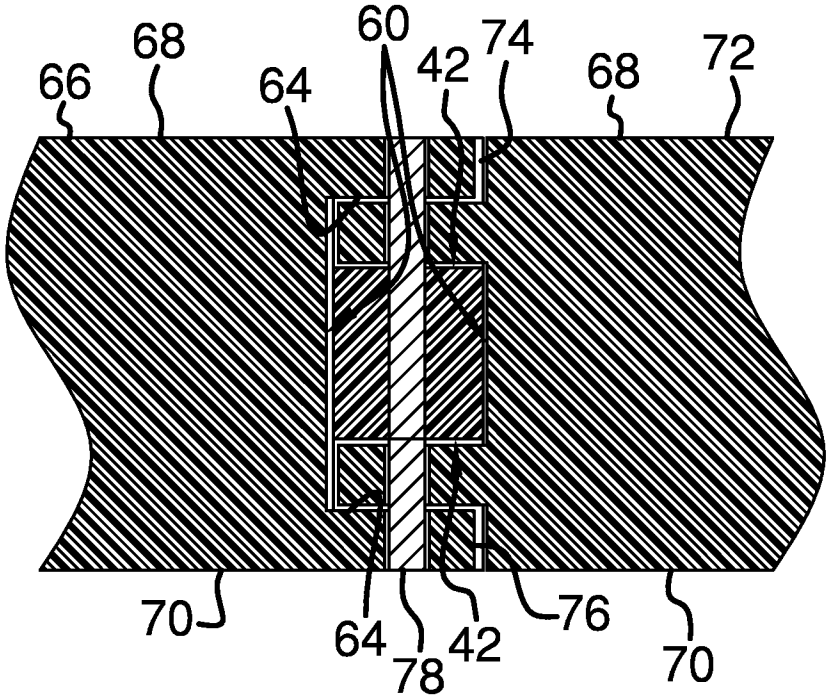
FIG. 3 is a cross sectional view taken along line 3-3 of FIG. 2 of an embodiment of the disclosure.
Figure 5:
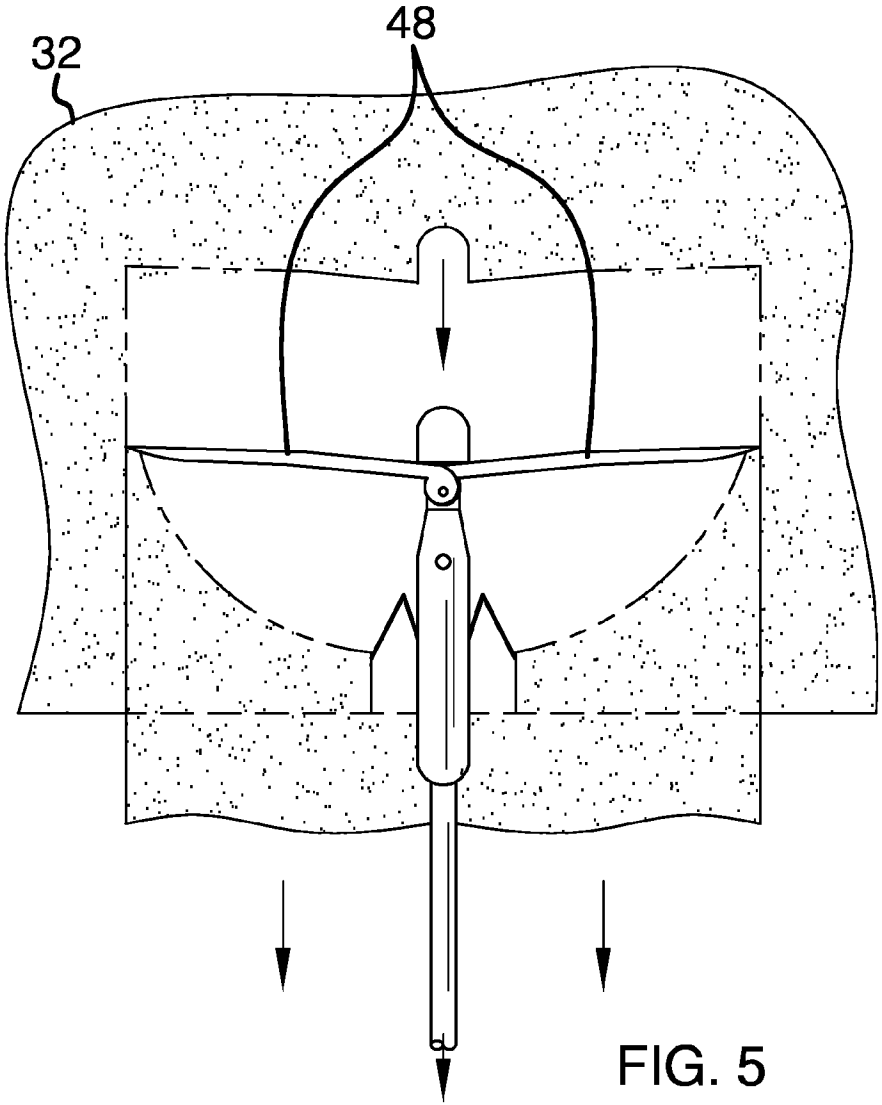
FIG. 5 is a top side view of an embodiment of the disclosure in a deployed position.
Figure 4:
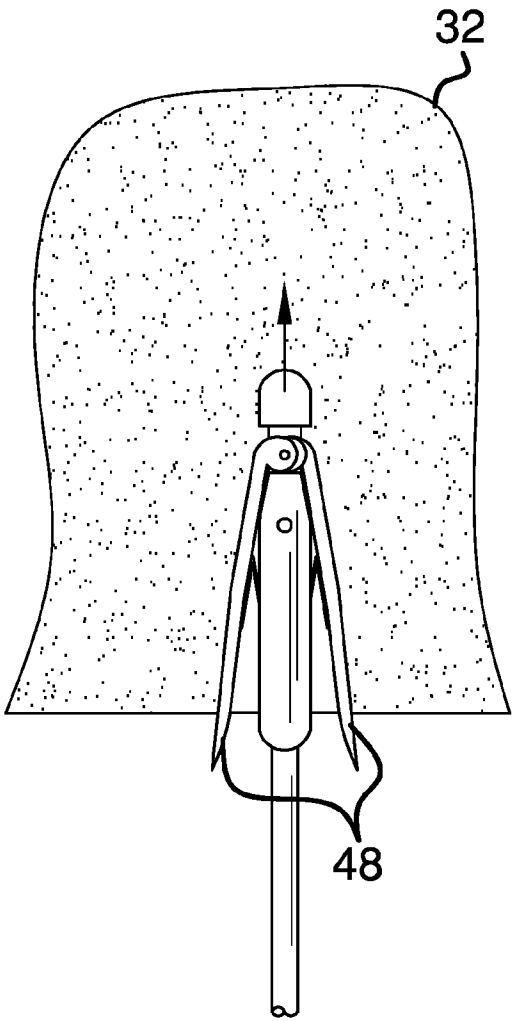
FIG. 4 is a top side view of an embodiment of the disclosure in a stored position.
Figure 6:
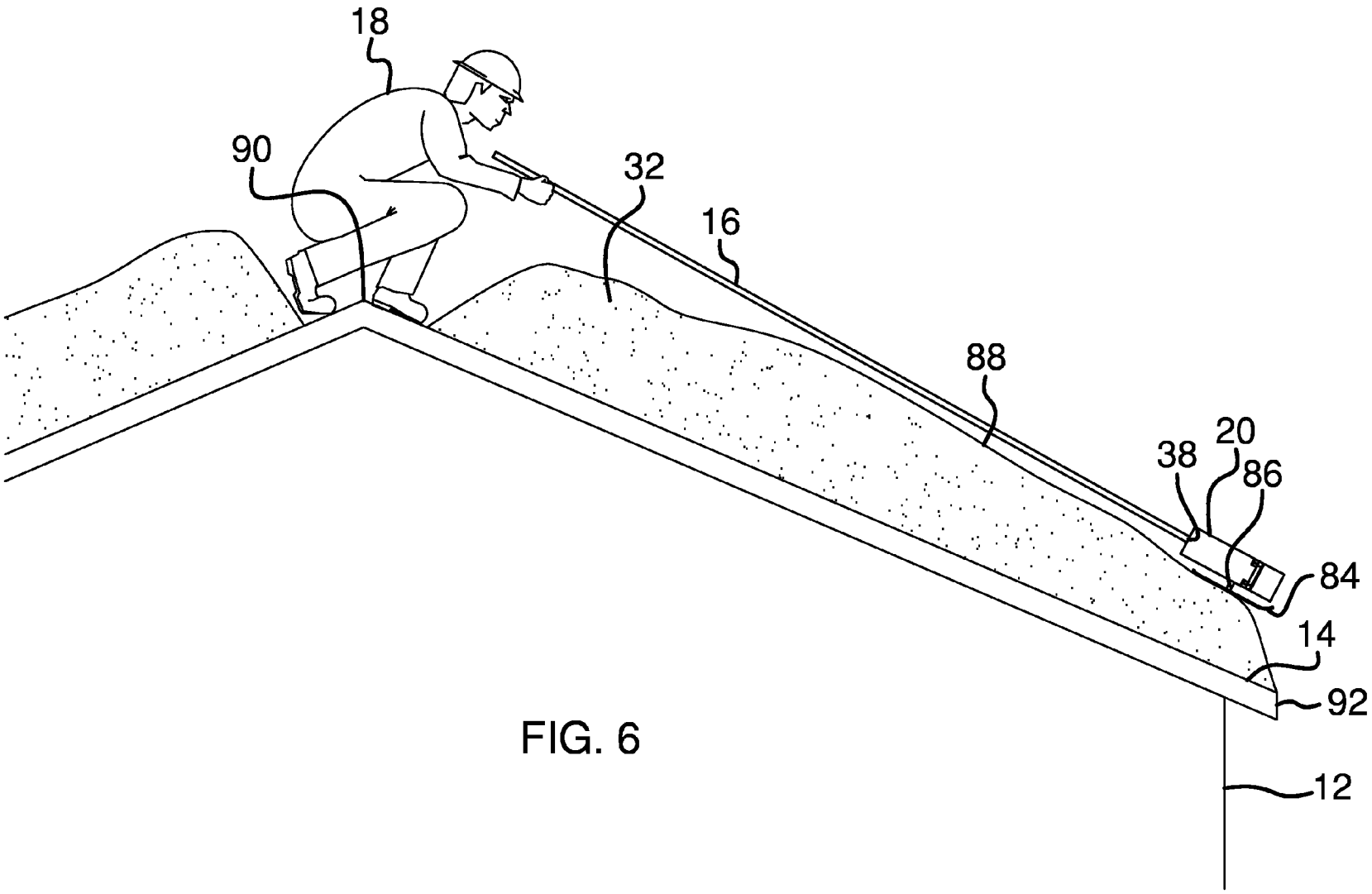
FIG. 6 is an in-use view of an embodiment of the disclosure.

With reference now to the drawings, and in particular to FIGS. 1 through 6 thereof, a new removal device embodying the principles and concepts of an embodiment of the disclosure and generally designated by the reference numeral 10 will be described.

As best illustrated in FIGS. 1 through 6, the snow removal assembly 10 generally comprises a building 12 structured to have a roof 14. The building 12 may be a building of any conventional design. A rod 16 is provided. The rod 16 may be gripped by a user 18 when the user 18 is standing on the roof 14 of the building 12. The user 18 may additionally be standing on ground.

A block 20 is provided. The block 20 has an outer surface 22 extending between each of a top surface 24 and a bottom surface 26 of the block 20. Each of a front side 28 and a back side 30 of the outer surface 22 of the block 20 is curved. The block 20 may easily side through snow 32 on the roof 14 of the building 12 without removing the snow 32 from the roof 14.

Each of the front 28 and back 30 sides of the outer surface 22 of the block 20 has an associated one of a pair of rod apertures 34 each extending therein toward a center 36 of the block 20. A coupled end 38 of the rod 16 threadably engages a selected one of the rod apertures 34. The block 20 is retained on the rod 16. A plug 40 is provided. The plug 40 is positioned within an un-used one of the rod apertures 34.

Each of the top 24 and bottom 26 surfaces of the block 20 have an associated one of a pair of wing slots 42 extending inwardly therein toward the center 36 of the block 20. The pair of wing slots 42 are each positioned proximate the front side 28 of the outer surface 22 of the block 20. Each of a first lateral side 44 and a second lateral side 46 of the outer surface 22 of the block 20 angles inwardly toward the center 36 of the block 20 proximate the wing slots 42.

A pair of wings 48 is provided. The wings 48 each has an outer edge 50 extending between each of a forward side 52 and a rearward side 54 of the wings 48. The wings 48 are each elongated between a free end 56 and a coupled end 58 of the wings 48. The coupled end 58 of the wings 48 each has a slot 60 extending inwardly toward the free end 56 of the wings 48.

Additionally, the wings 48 each has a pair of lobes 62 extending rearwardly from the rearward side 54 of the wings 48. The lobes 62 are each positioned on opposite ends 64 of the slot 60 in an associated one of the wings 48. The lobes 62 on a first one 66 of the wings 48 are positioned adjacent to an associated one of an upper side 68 and a lower side 70 of the outer edge 50 of the first wing 66. The lobes 62 on a second one 72 of the wings 48 are each spaced inwardly from the upper 68 and lower 70 sides of the outer edge 50 of the second wing 72.

The slot 60 on each of the wings 48 receives the block 20. Each of an upper one 74 and a lower one 76 of the lobes 62 on each of the wings 48 is positioned within an associated one of the pair of wing slots 42 in the block 20. The lower lobe 76 on the second wing 72 is positioned above the lower lobe 76 on the first wing 66. The upper lobe 74 on the second wing 72 is positioned beneath the upper lobe 74 on the first wing 66. A pin 78 extends through the lobes 62 on the wings 48 and engages the block 20. The wings 48 are each hingedly coupled to the block 20. The rearward side 54 of each of the wings 48 tapers to a point at the free end 56 of each of the wings 48.

A pair of biasing members 80 is each coupled to an associated one of the first 44 and second 46 lateral sides of the outer surface 22 of the block 20. The biasing members 80 each engages an associated one the wings 48. Additionally, the biasing members 80 each biases the associated wing 48 toward a deployed position.

The top surface 24 of the block 20 has a ski aperture 82 extending upwardly therein. A ski 84 is provided. A peg 86 is coupled to an extends upwardly from the ski 84. The peg 86 is removably positionable in the ski aperture 82. The ski 84 may be slid along a top 88 of the snow 32 on the roof 14.

In use, the user 18 stands on a peak 90 of the roof 14. The ski 84 is slid along the top 88 of the snow 32 to position the block 20 at an eave 92 of the roof 14. The block 20 is flipped over and urged in a first direction upwardly along the roof 14 beneath the snow 32. The wings 48 each extend rearwardly in a stored position along an associated one of the first 44 and second 46 lateral sides of the outer surface 22 of the block 20. The wings 48 move into the stored position when the block 20 is urged through the snow 32 in the first direction. The wings do not urge the snow 32 off of the roof 14.

The block 20 is urged in a second direction downwardly along the roof 14 beneath the snow 32 after the block 20 is positioned proximate the peak 90 of the roof 14. The wings 48 each extend in a deployed position laterally away from an associated one of the first 44 and second 46 lateral sides of the outer surface 22 of the block 20. The wings 48 move into the deployed position when the block 20 is urged through the snow 32 in the second direction. The rearward side 54 of the wings 48 captures the snow 32 to urge the snow 32 off of the roof 14. The block 20 is alternately moved through the snow 32 in the first and second directions to remove all of the snow 32 from the roof 14.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A snow removal assembly comprising:

a rod configured to be gripped by a user when the user is standing on a roof of a building;

a block coupled to said rod such that said block is configured to be urged through snow on the roof of the building, said block having an outer surface extending between each of a top surface and a bottom surface of said block, each of a front side and a back side of said outer surface of said block being curved such that said block is configured to easily slide through the snow, each of said front and back sides of said outer surface of said block having an associated one of a pair of rod apertures each extending therein toward a center of said block; and a pair of wings movably coupled to said block, said wings being retained in a stored position when said block is urged through the snow in a first direction, said wings being retained in a deployed position when said block is urged through the snow in a second direction such that said wings urge the snow off of said roof.

2. The assembly according to claim 1, further comprising a coupled end of said rod threadably engaging a selected one of said rod apertures wherein said block is retained on said rod.

3. The assembly according to claim 2, further comprising each of said top and bottom surfaces of said block having an associated one of a pair of wing slots extending inwardly therein toward a center of said block, said pair of wing slots each being positioned proximate said front side of said outer surface of said block.

4. The assembly according to claim 1, further comprising each of said wings having a outer edge extending between each of a forward side and a rearward side of said wings, said wings each being elongated between a free end and a coupled end of said wings.

5. The assembly according to claim 4, further comprising said coupled end of said wings each having a slot extending inwardly therein toward said free end of said wings.

6. The assembly according to claim 5, further comprising said wings each having a pair of lobes extending rearwardly from said rearward side of said wings, said lobes on each of said wings each being positioned on opposite sides of said slot in an associated one of said wings.

7. The assembly according to claim 5, further comprising said slot on each of said wings receiving said block such that said each of an upper one and a lower one of said lobes on each of said wings is positioned within an associated one of a pair of wing slots in said block.

8. The assembly according to claim 6, further comprising a pin extending through said lobes on said wings and engaging said block such that said wings are each hingedly coupled to said block.

9. The assembly according to claim 8, further comprising said wings each extending rearwardly along an associated one of a first lateral side and a second lateral side of an outer surface of said block when said block is urged through the snow in said first direction.

10. The assembly according to claim 9, further comprising said wings each extending laterally away from an associated one of a first lateral side and a second lateral side of said outer surface of said block when said block is urged through the snow in said second direction.

11. A snow removal assembly comprising:

a rod configured to be gripped by a user when the user is standing on a roof of a building;

a block, said block having an outer surface extending between each of a top surface and a bottom surface of said block, each of a front side a back side of said outer surface of said block being curved such that said block is configured to easily side through snow on said roof of said building;

each of said front and back sides of said outer surface of said block having an associated one of a pair of rod apertures each extending therein toward a center of said block, a coupled end of said rod threadably engaging a selected one of said rod apertures wherein said block is retained on said rod;

each of said top and bottom surfaces of said block having an associated one of a pair of wing slots extending inwardly therein toward said center of said block, said pair of wing slots each being positioned proximate said front side of said outer surface of said block;

a pair of wings, each of said wings having a outer edge extending between each of a forward side and a rearward side of said wings, said wings each being elongated between a free end and a coupled end of said wings;

said coupled end of said wings each having a slot extending inwardly therein toward said free end of said wings;

said wings each having a pair of lobes extending rearwardly from said rearward side of said wings, said lobes on each of said wings each being positioned on opposite sides of said slot in an associated one of said wings;

said slot on each of said wings receiving said block such that said each of an upper one and a lower one of said lobes on each of said wings is positioned within an associated one of said pair of wing slots in said block;

a pin extending through said lobes on said wings and engaging said block such that said wings are each hingedly coupled to said block;

said wings each extending rearwardly in a stored position along an associated one of a first lateral side and a second lateral side of said outer surface of said block when said block is urged through the snow in a first direction; and said wings each extending in a deployed position laterally away from an associated one of a first lateral side and a second lateral side of said outer surface of said block when said block is urged through the snow in a second direction such that said wings urge the snow off of said roof.

* * * * *